US008112028B2

(12) United States Patent
Miyamoto et al.

(10) Patent No.: US 8,112,028 B2
(45) Date of Patent: Feb. 7, 2012

(54) CONDUCTIVE ROLL, CLEANING ROLL, CLEANING UNIT, PROCESS CARTRIDGE, AND IMAGE-FORMING APPARATUS

(75) Inventors: Tsuyoshi Miyamoto, Kanagawa (JP); Yukio Hara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 488 days.

(21) Appl. No.: 12/055,423

(22) Filed: Mar. 26, 2008

(65) Prior Publication Data

US 2008/0253816 A1 Oct. 16, 2008

(30) Foreign Application Priority Data

Apr. 12, 2007 (JP) ..... 2007-105126

(51) Int. Cl.
*G03G 21/00* (2006.01)
*G03G 15/00* (2006.01)

(52) U.S. Cl. ..... 399/357; 399/343; 399/349

(58) Field of Classification Search ..... 399/343, 399/353, 354, 357; 492/53; 430/125.31, 430/125.5, 125.6; 15/256.51, 256.52, 256.53
See application file for complete search history.

(56) References Cited

U.S. PATENT DOCUMENTS

| | | | | | |
|---|---|---|---|---|---|
| 5,061,533 | A | * | 10/1991 | Gomi et al. | 428/36.3 |
| 5,685,043 | A | * | 11/1997 | LaManna et al. | 15/256.52 |
| 6,122,479 | A | * | 9/2000 | Fujita et al. | 399/333 |
| 7,103,304 | B2 | * | 9/2006 | Hara | 399/176 |
| 7,171,152 | B2 | * | 1/2007 | Akagi et al. | 399/356 |

FOREIGN PATENT DOCUMENTS

| | | | |
|---|---|---|---|
| JP | A 1-1312578 | | 12/1989 |
| JP | 2001305836 | A * | 11/2001 |
| JP | 2003277522 | A * | 10/2003 |
| JP | A 2004-69849 | | 3/2004 |
| JP | A 2004-348033 | | 12/2004 |
| JP | A 2005-82347 | | 3/2005 |
| JP | A 2005-265907 | | 9/2005 |
| JP | A 2005-275087 | | 10/2005 |
| JP | 2006103140 | A * | 4/2006 |

* cited by examiner

*Primary Examiner* — David Gray
*Assistant Examiner* — Fred L Braun
(74) *Attorney, Agent, or Firm* — Oliff & Berridge, PLC

(57) ABSTRACT

Provided is a cleaning roll (conductive roll) including a core, a coating layer formed thereon, and a shaft along the axis of the core. The coating layer contains a bismaleimide resin and a conductive agent. Also provided are a cleaning unit, a process cartridge, and an image-forming apparatus employing the conductive roll. The conductive roll may include a core and a coating layer containing a bismaleimide resin and a conductive agent formed on the external peripheral surface of the core.

11 Claims, 5 Drawing Sheets

CONDUCTIVE ROLL, CLEANING ROLL, CLEANING UNIT, PROCESS CARTRIDGE, AND IMAGE-FORMING APPARATUS

CROSS-REFERENCE TO RELATED APPLICATION

This application claims priority under 35 USC 119 from Japanese Patent Application No. 2007-105126, filed Apr. 12, 2007.

BACKGROUND

1. Technical Field

The present invention relates to a conductive roll, a cleaning roll, a cleaning unit, a process cartridge, and an image-forming apparatus.

2. Related Art

Cleaning units having a cleaning blade made of an elastic material such as rubber, in which, for removal of developers, such as toner, adhered to the surface of a image-holding member such as a photoreceptor, one edge of the blade is brought into contact with the surface of the image-holding member have been known in the art as cleaning apparatuses for image-forming apparatuses such as electrophotographic copying machine.

Such a cleaning apparatus is advantageous in that the configuration thereof is simple, low-cost, and the toner can be removed efficiently. It is very important in such a system to bring the contact area of the cleaning blade into contact with the surface of an image-holding member stably, and with uniform pressure, over a long period of time.

Generally, an external additive that is a substance with a smaller particle diameter (average particle diameter: approximately 1 nanometer or more and 50 nanometer or less) than a toner is mixed with the toner to improve the powder flowability, charging properties, transfer efficiency, and the cleaning efficiency of the toner. Because the blending amount of the external additive depends on the specific surface area of the toner, the blending amount of the external additive increases with decreasing toner particle diameter. Naturally, as the consumption amount of the toner during image formation increases, the amount of the external additive reaching the cleaning unit also increases. For example, due to the large number of photographic originals, the amount of toner consumed is approximately 10 times greater in a full-color image-forming apparatus, in which development using four color toners is sequentially performed, as compared with toner consumption in common apparatuses for black and white document and thus, the amount of the external additive used is also increased significantly.

SUMMARY

According to an aspect of the present invention, there is provided a conductive roll, comprising a core and a coating layer comprising a bismaleimide resin and a conductive agent, the coating layer being formed on the external peripheral surface of the core.

BRIEF DESCRIPTION OF THE DRAWINGS

Exemplary embodiments of the present invention will be described in detail based on the following figures, wherein.

DETAILED DESCRIPTION

Hereinafter, the invention will be described particularly with reference to drawings. The same denotations are allocated to parts having substantially the same function throughout the drawings, and duplicated description thereof is not repeated.

(Cleaning Roll/Conductive Roll)

Figure 1:
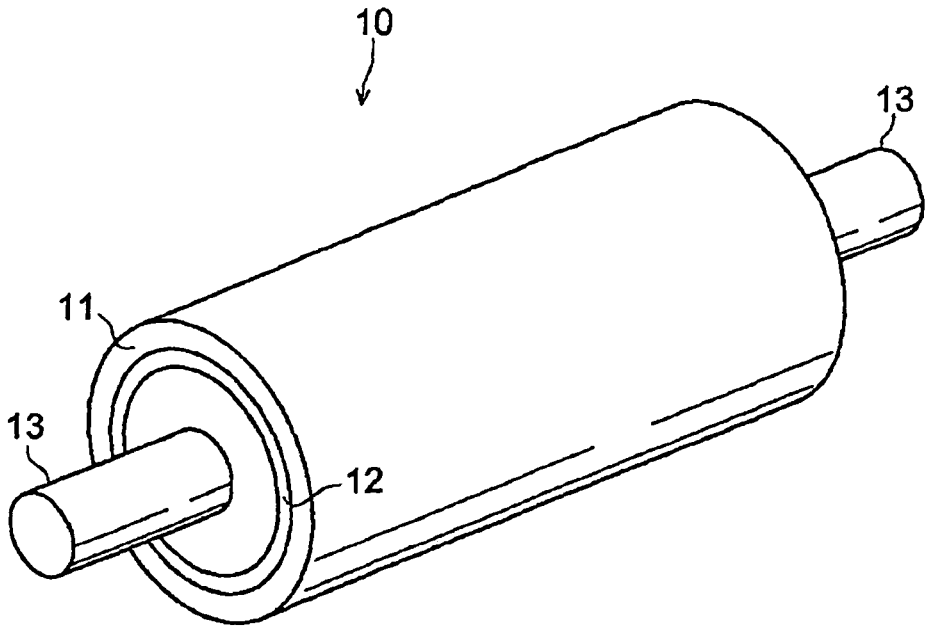
FIG. 1 is a perspective view illustrating a cleaning roll in an exemplary embodiment.
Figure 2:
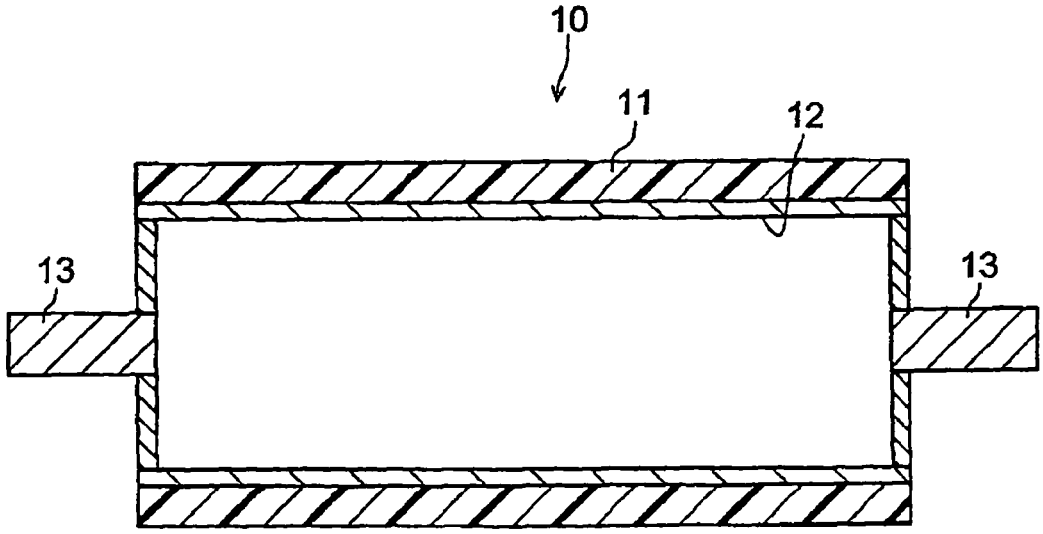
FIG. 2 is a schematic sectional view illustrating a cleaning roll in an exemplary embodiment.

FIG. 1 is a perspective view illustrating the cleaning roll (conductive roll) in an exemplary embodiment. FIG. 2 is a schematic sectional view illustrating the cleaning roll (conductive roll) in the exemplary embodiment.

As shown in FIGS. 1 and 2, a cleaning roll 10 in an exemplary embodiment is configured by a conductive roll having a core cylinder 12 with a coating layer 11 and a shaft 13, disposed along the central axis of the core cylinder 12. The coating layer 11 is configured to contain a bismaleimide resin and a conductive agent. "Conductive" does not just refer to having a volume resistivity of, for example, less than $10^7$ Ωcm, but also to a semiconductive material having a volume resistivity of, for example, $10^7$ Ωcm to $10^{13}$ Ωcm. The same definitions are applied the descriptions hereinafter.

The cleaning roll 10 in the present exemplary embodiment, which has a coating layer 11 as described above, is compact and light-weight, and may remove toner and external additives from the object to be cleaned over a long period of time and may prevent toner and external additives from adhering to the surface of the object. Although the reason for this is not certain, it is thought to be for the following reasons.

The bismaleimide resin used in the coating layer 11 has a three-dimensional network structure in which imide rings are crosslinked, and thus, the layer has a high hardness and a smooth surface. In addition, because the monomer component-containing solution for preparation of the bismaleimide resin has a low viscosity, there is high flowability thereof, and it is possible to form a coating layer in which the conductive agent is uniformly dispersed and also possible to form a thinner layer. It is thus possible to prepare a compact and light-weight conductive roll having superior durability and slidability, together with reduced resistance fluctuation with current supply and environmental changes. It is thought that by using such a conductive roll, it is possible to make a compact and light-weight conductive roll that may remove toner and external additives from the object to be cleaned over a long period of time and may prevent toner and external additives from adhering to the surface of the object.

Hereinafter, respective components of the conductive roll will be described in detail. First, the core cylinder 12 will be described. Examples of the core cylinder 12 include core cylinders made of a metal such as stainless steel (SUS), aluminum, copper, and iron.

Next, the coating layer 11 will be described. As described above, the coating layer 11 contains a bismaleimide resin and a conductive agent. The bismaleimide resin will be described.

The bismaleimide resin is a kind of polyimide resin formed by crosslinking imide rings to form a three-dimensional network structure. Since a bismaleimide resin has a superior durability and slidability, and reduced resistance fluctuation with current supply and environmental changes, and such a bismaleimide resin is preferably, for example, a copolymer of a bismaleimide compound and an amine compound as monomer components. Such a copolymer is obtained, for example, by reacting a bismaleimide compound with an amine compound in a solvent.

The bismaleimide compound may be produced by addition reaction of a diamine compound with maleic anhydride or derivative thereof. Diamine compounds that may be used are, for example, such diamine compounds as will be described later. Typical examples that may be given of maleic anhydride or derivatives thereof, include, specifically, maleic anhydride, citraconic anhydride, dimethylmaleic anhydride, ethylmaleic anhydride, diethylhaleic anhydride, ethylmaleic anhydride, chloromaleic anhydride, dichloromaleic anhydride, and the like.

Examples of the bismaleimide compound include an aliphatic bismaleimide compound, an aromatic bismaleimide compound or the like, depending on the structure of the diamine compound used in production.

Examples of the aliphatic bismaleimide compounds include aliphatic bismaleimides and alicyclic bismaleimides such as meta-xylylenebismaleimide, propanebismaleimide, tetramethylenebismaleimide, pentamethylenebismaleimide, octamethylenebismaleimide, nonamethylenebismaleimide, 4,4-heptamethylenebismaleimide, 1,4-cyclohexanebismaleimide, isophoronebismaleimide, tetralydrodicyclopentadienylenebismaleimide, hexahydro-4,7-methanoindanylene dimethylenebismaleimide, tricyclo[6,2,1,02.7]-undecylene-dimethyl-bismaleimide, 4,4'-methylene-bis(cyclohexylmaleimide), and the like.

Examples of the aromatic bismaleimide compounds include 4,4'-diphenylmethanebismaleimide, polyphenyl methane maleimide, m-phenylenebismaleimide, p-phenylenebismaleimide, bisphenol A diphenylether bismaleimide, 3,3'-dimethyl-5,5'-diethyl-4,4'-diphenylmethanebismaleimide, 4-methyl-1,3-phenylenebismaleimide, 4,4'-diphenylether bismaleimide, 3,4'-diphenylether bismaleimide, 3,3'-diphenylether bismaleimide, 4,4'-diphenylsulfonebismaleimide, 1,3-bis(3-maleimidophenoxy)benzene, 1,3-bis(4-maleimidophenoxy)benzene, and the like.

Examples of the amine compounds include aliphatic amine compounds and aromatic amine compounds.

Examples of the aliphatic diamine compounds include aliphatic diamines and alicyclic diamines such as 1,1-meta-xylylenediamine, 1,3-propanediamine, tetramethylenediamine, pentamethylenediamine, octamoethylenediamine, nonamethylenediamiline, 4,4-diaminoheptamethylenediamine, 1,4-diaminocyclohexane, isophoronediamine, tetrahydrodicyclopentadienylenediamine, hexahydro-4,7-methanoinadanylene dimethylenediamine, tricyclo[6,2,1,02.7]-undecylene-dimethyldiamine, and 4,4'-methylene-bis(cyclohexylamine), and the like.

Examples of the aromatic diamine compounds include p-phenylenediamine, n-phenylenediamine, 4,4'-diaminodiphenylmethane, 4,4'-diaminodiphenyl ethane, 4,4'-diaminodiphenylether, 4,4'-diaminodiphenylsulfide, 4,4'-diaminodiphenylsulfone, 1,5-diaminonaphthalene, 3,3-dimethyl-4,4'-diaminobiphenyl, 5-amino-1-(4'-aminophenyl)-1,3,3-trimethylindane, 6-amino-1-(4'-aminophenyl)-1,3,3-trimethylindane, 4,4'-diaminobenzanilide, 3,5-diamino-3'-trifluoromethylbenzanilide, 3,5-diamino-4'-trifluoromethylbenzanilide, 3,4'-diaminodiphenylether, 2,7-diaminofluorene, 2,2-bis(4-aminophenyl)hexafluoropropane, 4,4'-methylene-bis(2-chloroaniline), 2,2',5,5'-tetrachloro-4,4'-diaminobiphenyl, 2,2'-dichloro-4,4'-diamino-5,5'-dimethoxybiphenyl, 3,3'-dimethoxy-4,4'-diaminobiphenyl, 4,4'-diamino-2,2'-bis(trifluoromethyl)biphenyl, 2,2-bis[4-(4-aminophenoxy)phenyl]propane, 2,2-bis[4-(4-aminophenoxy)phenyl]hexafluoropropane, 1,4-bis(4-aminophenoxy)benzene, 4,4'-bis(4-aminophenoxy)-biphenyl, 1,3'-bis(4-aminophenoxy)benzene, 9,9-bis(4-aminophenyl)fluorene, 4,4'-(p-phenyleneisopropylidene)bisaniline, 4,4'-(m-phenyleneisopropylidene)bisaniline, 2,2'-bis[4-(4-amino-2-trifluoromethylphenoxy)phenyl]hexafluoropropane, 4,4'-bis[4-(4-amino-2-trifluoroethyl)phenoxy]-octafluorobiphenyl, and the like.

The bismaleimide resin is preferably a copolymer of an aromatic bismaleimide compound and an aromatic amine compound. It is thus possible to obtain superior durability and slidability, and thereby effectively reducing resistance fluctuation with current supply and environmental changes. Although the reason is not clear, it is considered that, as compared with an aliphatic monomer, aromatic rings crosslink to form a network structure so that an electrically stable structure having a rigid and smooth surface, and a reduced water absorbability attributable to a packing effect by the aromatic rings can be obtained.

In particular, from the view point of high rigidity and superior abrasion resistance, the bismaleimide resin is preferably a polymer of 4,4'-diphenylmethanebismaleimide as an aromatic bismaleimide compound and at least one of diaminodiphenylmethane as an aromatic amine component or p-phenylene.

The monomer components of the bismaleimide resin, i.e., a bismaleimide compound and an amine compound, may respectively be used alone or in combinations of two or more.

The ratio of the bismaleimide compound to the amine compound (bismaleimide compound/amine compound) in the bismaleimide resin can be selected properly according to required physical properties of the resin in the range of 1/1 to 4/1 (mole/mole), preferably in the range of 1.5/1 to 3/1 (mole/mole) and more preferably in the range of 1.7/1 to 2.5/1 mole/mole). When the ratio of bismaleimide compound and amine compound is the stoichiometric ratio of 2/1 (mole/mole) the crosslinking degree of the bismaleimide resin becomes highest, to form a rigid and superior abrasion resistance structure.

A polar organic solvent may be appropriately used as the solvent for synthesizing the bismaleimide resin. Examples of the polar organic solvents include N-methyl-2-pyrrolidone, N,N-dimethylacetamide, dimethylsulfoxide, hexamethylphosphortriamide and the like. A phenol such as cresol, phenol, or xylenol or a hydrocarbon such as hexane, benzene, or toluene may be added to the polar organic solvent as needed. These solvents may also be used alone or in combinations of two or more.

In addition to the bismaleimide resin, for example, a resin material having a superior abrasion resistance such as a polyimide resin (linear-chain type), a polyphenylene sulfide, a polyether sulfide, a polyether imide, or a polyarylate may be used in the coating layer 11 within a range that does not impair the properties of the bismaleimide resin used.

Hereinafter, the conductive agent will be described. Examples of the conductive agents include carbon black, carbon powder, graphite, magnetic powders, metal oxides such as zinc oxide, tin oxide, and titanium oxide; metal sulfides such as copper sulfide and zinc sulfide; so-called hard ferrites such as of strontium, barium, and rare-earth metals; ferrites such as of magnetite, copper, zinc, nickel and manganese; those with the surface made conductive as needed; metal powders and metal fibers such as of tin, iron, copper, and aluminum; oxides containing different metal elements such as copper, iron, manganese, nickel, zinc, cobalt, barium, aluminum, tin, lithium, magnesium, silicon, and phosphorus; so-called composite metal oxides, such as solid solutions of metal oxides, obtained by sintering, for example, metal hydroxides, carbonate salts or metal compounds at high temperature; and the like.

The conductive agent is preferably an electron-conductive agent showing conductivity by electron conduction for the purpose of reducing the change in electric resistance between a high-temperature high-humidity environment, such as at 30° C. and 85% RH, and a low-temperature low-humidity environment, such as at 10° C. and 15% RH.

The electron-conductive agent is, for example, carbon black having a pH of 5.0 or less (hereinafter, referred to as "acidic carbon black"). The pH is preferably pH 5.0 or less, more preferably pH 4.0 or less. When the electron-conductive agent has a pH of 5.0 or less, the dispersibility of the agent is improved in the resin material by the action of oxygen-containing functional groups adhered onto the surface, and dependency on an electric field becomes low, electric field concentration is not liable to occur, and there are smaller resistance fluctuation with environmental changes.

The acidic carbon black may be subjected to oxidation treatment, as occasion demands, to introduce groups such as carboxyl, quinone, lactone and hydroxyl onto the surface of the acidic carbon black. Oxidation treated carbon black may be suitably used as the acidic carbon black in the present exemplary embodiment.

Examples of oxidation methods include an air oxidation method of oxidizing carbon black in air in a high-temperature atmosphere (e.g., from 300° C. to 800° C.), a method of allowing carbon black to react with nitrous oxide and ozone at room temperature (e.g., 25° C.), and a method of performing air oxidation at high temperature (e.g., from 300° C. to 800° C.) and subsequent ozone oxidation at low temperature (e.g., from 20° C. to 200° C.), and the like. Specifically, the oxidized carbon black is produced, for example, by a contact method. Examples of the contact methods include channel method and gas black method, and the like.

Alternatively, the acidic carbon black may be produced by a furnace black method of using gas or oil as a raw material. After these treatments, the carbon black may be subjected to a liquid phase oxidation treatment with nitric acid and the like, if necessary. Normally, only carbon black having a high pH value and a low volatile component can be prepared by a furnace method, but the pH value thereof can be adjusted by subjecting such furnace black to liquid phase acid treatment. Thus, the pH value of the carbon black obtained by the furnace method, can be adjusted by a post-treatment step. For that reason, the carbon black may be a carbon black obtained by the furnace method which has been adjusted to a pH value of 5 or less in a post-treatment step.

The pH value of the oxidized carbon black can be determined by preparing an aqueous suspension of the carbon black and measuring the pH value with a glass electrode. The pH value of the oxidized carbon black may be adjusted in accordance with the processing conditions such as processing temperature and time in the oxidation treatment.

Volatile components in the acidic carbon black are preferably in an amount of 1% by weight to 25% by weight, preferably 2% to 20%, more preferably, 3.5% to 15%. When the volatile components are less than 1% by weight, the oxygen-containing functional groups adhered to the surface of the carbon black do not exert their effects, resulting in deterioration in dispersibility in resin. On the other hand, when the content exceeds 25% by weight may cause problems such as decomposition during dispersion of the carbon black in the binder resin and deterioration in appearance of the molded product obtained due to an increase in the amount of water attracted by the oxygen-containing functional group on the surface of the carbon black. Therefore, it is possible to disperse the carbon black in the binder resin more favorably by adjusting the volatile components to within the above ranges. The volatile material components is determined by the ratio of the organic volatile components (carboxyl group, quinone group, lactone group, hydroxyl group and the like) generated when carbon black is heated at 950° C. for 7 minutes.

Specific examples of the acidic carbon black include "REGAL 400R" (PH: 4.0, volatile material: 3.5%) and "MONARCH 1300" (PH: 2.5, volatile component: 9.5%) manufactured by Cabot; "Color Black FW200" (PH: 2.5, volatile component: 20%), "SPECIAL BLACK 4" (PH: 3, volatile component: 14%), "PRINTEX 150T" (PH: 4, volatile material: 10%), "PRINTEX 140T" (PH: 5, volatile component: 5%), and "PRINTEX U" (PH: 5, volatile component: 5%) manufactured by Degussa Japan; and the like. Such acidic carbon blacks may be used alone or in combinations with other carbon blacks, as long as an electrically-conductive filler that exerts the main conductive effect is used.

The addition amount of the conductive agent is preferably 5 parts to 40 parts by weight with respect to 100 parts by weight of the resin, and more preferably 10 parts to 30 parts by weight. An addition amount of less than 5 pats by weight or more than 40 parts by weight may not obtain the desired electric resistance stably. In dispersing the conductive agent, a method of using a ball mill, attriter, sand mill, pressurized kneader, Banbury mixer, two-roll mixer, three-roll mixer, extruder, or the like may be suitably used.

The thickness of the coating layer 11 containing the bismaleimide resin and the conductive agent is preferably in the range of 0.01 mm to 0.1 mm, more preferably 0.02 mm to 0.08 mm. A coating layer 11 thickness of less than 0.01 mm may cause a problem that the tube layer leaks with the applied voltage, while a thickness of more than 0.1 mm may lead to the coating layer (bismaleimide resin layer) not being formed uniformly.

The cleaning roil 10 in the present exemplary embodiment described above preferably has an electric resistance at an applied voltage of 500 V in the range of $1\times10^5\Omega$ to $1\times10^{10}\Omega$, more preferably in the range of $1\times10^5\Omega$ to $1\times10^9\Omega$. The electric resistance of the conductive roll is adjusted to within the predetermined ranges above by, for example, adjusting the addition amount of the acidic carbon exemplified above as the conductive agent.

When the electric resistance is less than $1\times10^5\Omega$, charge injection takes place in the cleaning unit, and therefore reversal of the polarity of fine powder such as toner and paper dust scraped off with the brush member occurs, thus resulting in an inability to carry out electrical adherence. When the electric resistance is more than $1\times10^{10}\Omega$, a so-called charge up, i.e., accumulation of electric charge on the conductive roll takes place, consequently fine powder such as the toner and paper dust may not be electrically attracted.

The electric resistance is determined by placing a cleaning roll on the surface of a metal plate such as a copper plate with a load of 500 g being applied to both ends of the roll, measuring the current value (I), at 10 seconds after application of a voltage (V) of 500 V between the conductive roll (between the core material, if present) and the metal plate under an environment of 25° C. and 70% RH by using a micro electric current analyzer (trade name: R8320, manufactured by Advantest), and calculating according to Formula: R=V/I (Ω).

The cleaning roll 10 in the present exemplary embodiment preferably has a wear amount, as determined according to JIS-K6902 (1998), of 20 mg or less, more preferably 10 mg or less, and still more preferably 5 mg or less.

In the cleaning unit described below, the cleaning roll 10 in the present exemplary embodiment is in contact, for example, with other parts (electrophotographic photoreceptor (image-holding member), cleaning blade, cleaning brush and image-receiving medium, and the like). Accordingly, it is required to be configured from an abrasion resistant material, and a cleaning roll 10 having a wear loss of more than 20 mg is required to be replaced with a short cycle due to abrasion. On the other hand, with a wear resistant cleaning roll 10 it is possible to raise the contact pressure and the bite (contact depth) of the brush member or the blade-shaped cleaning member in the cleaning unit and thus to clean stably over a long period of time.

The cleaning roll 10 in the present exemplary embodiment is produced, for example, by forming a coating layer 11 on a core cylinder 12. For example in forming a coating layer (bismaleimide resin/conductor layer) on a core cylinder 12, favorably used is a method of preparing a coating solution formed by dispersing a conductive agent in a solution formed by dissolving a bismaleimide compound and an amine compounds in a solvent (polar organic solvent), coating the coating solution on a core cylinder 12, reacting the bismaleimide compound with the amine compound to thereby convert into a bismaleimide-type polyimide resin (bismaleimide resin) while the solvent is removed by heat treatment, and thus, form a bismaleimide-type polyimide resin layer (bismaleimide resin layer) on the surface of the core cylinder 12.

The coating method of production by using a solvent gives a layer with a high precise thickness and without defects of the roll surface as compared with solvent-free treatment methods. As a result, the various rolls obtained can exert superior properties in, for example, cleaning efficiency, operation stability, and durability.

Figure 3:
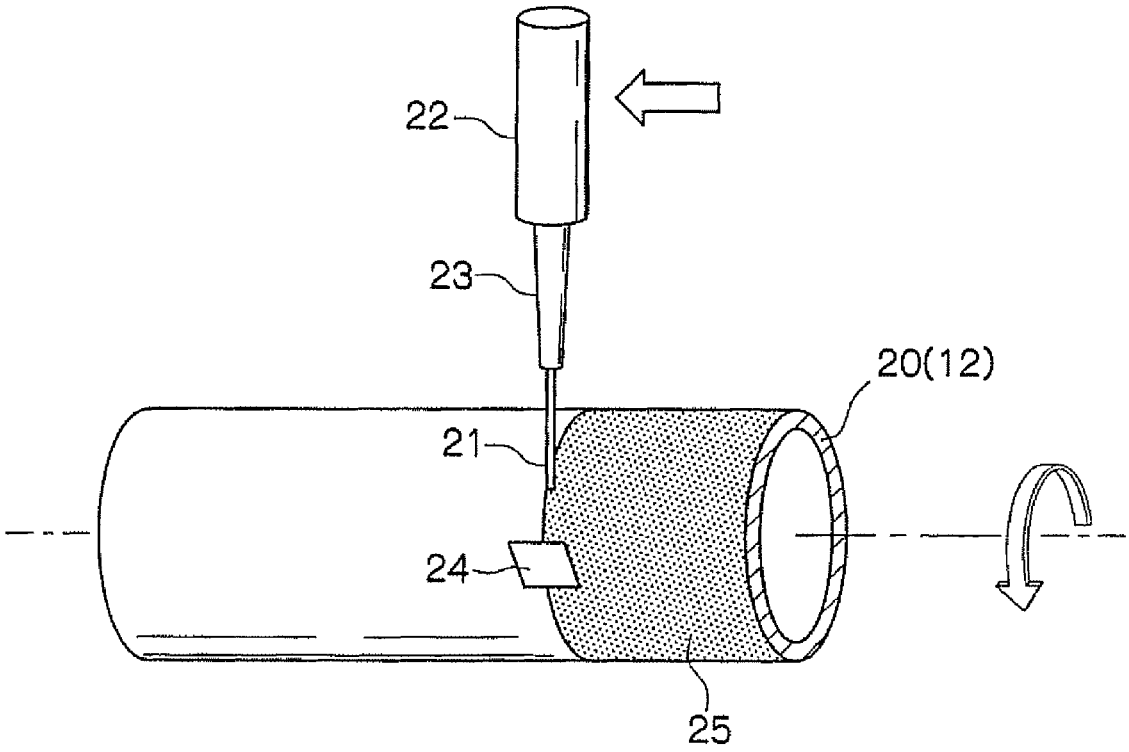
FIG. 3 is a schematic view explaining the flow coating method used in preparation of a cleaning roll in an exemplary embodiment.

The method of coating a coating solution on the core cylinder 12 is not particularly limited, but, from the point of productivity, is preferably a flow coating method. Such a flow coating method is a method of coating a coating solution on the surface of a bar or cylinder by pouring the coating solution downward onto the surface of a core cylinder and flattening the coating solution with a spatula and shifting the pouring position of the coating-solution and the blade-shaped spatula from one end to the other end of the cylinder in a horizontal direction (along the core-cylinder axial direction). FIG. 3 is a schematic view explaining such a flow coating method.

In FIG. 3, a coating solution 21 flows downward from a container 22 through a nozzle 23, while the cylinder 20 (core cylinder 12) is rotated in the arrow direction (circumferential direction). The downward flowing coating solution 21 is flattened by a spatula 24. The coated layer 25 immediately after passing through the spatula 24 often has streaks, but the streaks disappear over time because of the viscosity of the solution. The entire surface of the cylinder 20 is coated, while the container 22 and the spatula 24 are coupled, and simultaneously moved from one end to the other end of the cylinder 20 in the horizontal direction (in the axial direction). The traveling speed corresponds to the coating speed.

As for the coating conditions, the rotational velocity of the cylinder 20 is about 20 rpm to about 200 rpm; the coating speed V which is dependent on the external diameter k of the cylinder 20, the flow rate f of the coating solution 21, and the desired wet layer thickness t, is expressed by Formula: $V=f/(t-k-\pi)$. π is the ratio of the circumference of a circle to its diameter.

If the coating solution 21 does not flow effectively by gravity alone due to a high viscosity thereof it is effective to extrude the solution with air pressure or with a pump. The distance between the nozzle 23 and the cylinder 20 may be selected from a number of values, but is preferably approximately 10 mm to 100 mm to ensure an uninterrupted supply of the coating solution. If there are breaks in the supply of the solution then this may result in incorporation of bubbles into the solution.

The spatula 24 is elastic and resistant to solvent and is, for example, formed of a plastic such as polyethylene or a fluoroplastic resin, or from a metal plate such as brass or stainless steel. The spatula is formed into a shape of 10 min to 50 mm in width and is brought into slight contact with the cylinder 20. Glen the coating solution 21 passes the position of the spatula 24, the coating solution 21 is spread out by the spatula 24 as the spatula is separated from the cylinder 20 with a given clearance.

The present exemplary embodiment has been described above with reference to the cleaning roll 10, however, such a conductive roll that is suitable for this application is also applicable to other rolls, such as transfer roll, belt-supporting roll, belt drive roll, conveyor roll, fixing roll, sliding roll, and pressure roll.

(Cleaning Unit)

Figure 4:
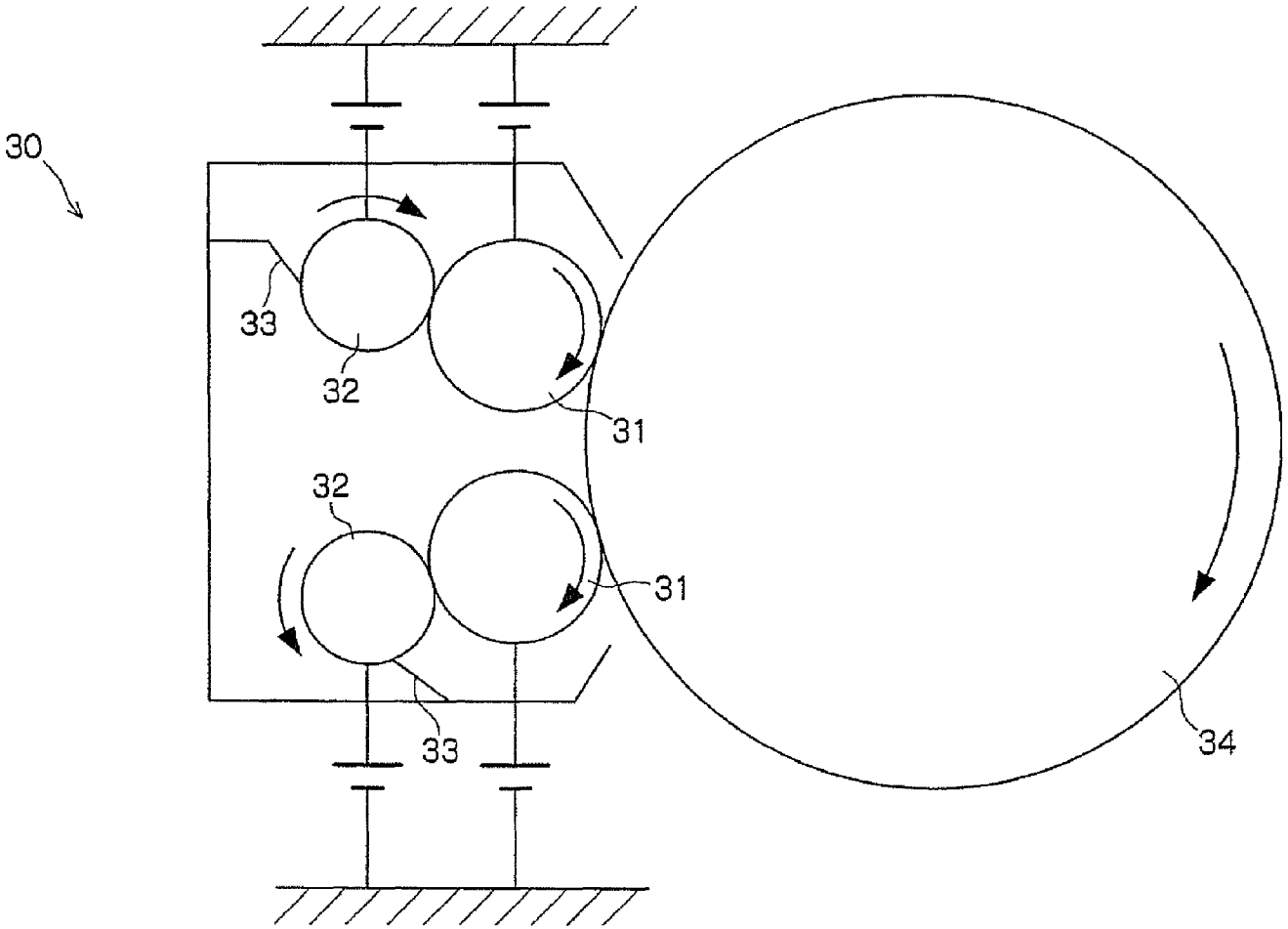
FIG. 4 is a schematic view illustrating the configuration of a cleaning unit in an exemplary embodiment.

FIG. 4 is a schematic view illustrating a configuration of a cleaning unit in the present exemplary embodiment.

As shown in FIG. 4, the cleaning unit 30 in the present exemplary embodiment is configured with brush members 31 carrying a number of fibers inserted into a revolving shaft (not shown in the figure), cleaning rolls 32 in contact with the brush members 31, and cleaning blades 33 (scrapers) in contact with the cleaning rolls 32. The cleaning roll 10 in the above-mentioned exemplary embodiment is used as the cleaning rolls 32. Thus, the cleaning unit 30 in the present exemplary embodiment may remove the toner and the external additives from the electrophotographic photoreceptor (image-holding member) over a long period of time, and may inhibit adhesion of the toner and the external additives onto the surface of the electrophotographic photoreceptor, so that high-quality images may be obtained. As a result, superior durability of the electrophotographic photoreceptor and a reduction in running cost may be achieved.

The brush members 31 are formed in a roll-shape by inserting a number of fibers on the outer periphery of revolving shafts. The brush members 31 are placed at positions where the electrophotographic photoreceptor 34 (image-holding member; member to be cleaned) bites in (is disposed below the plane of the tip ends) to the brush bristles, and play a role in separation of the toner and the external additives from the surface of the electrophotographic photoreceptor 34 and in transportation of the toner and the external additives to cleaning rolls 32 by bringing the tip end of the brush bristles into contact with the electrophotographic photoreceptor 34, while the peripheral surfaces of the brush members 31 are rotated in the direction opposite to the traveling direction of the peripheral surface of the electrophotographic photoreceptor 34.

Specific materials for the brush members 31 include resin fibers, such as nylon, acrylics, polyolefin, polyester and the like. The brush members 31 may be formed in such a manner that a conductive powder or an ion conductive agent are blended into the materials of the brush members to impart electric conductivity thereto, so that an electrically conductive layer is formed on the surface or inside of each fiber.

The resistance value of the fiber is preferably in the range of $10^2\Omega$ to $10^9\Omega$. The fineness of the fibers is preferably 30d or less, and is more preferably 20d or less. The density of the fibers is preferably $3.1\times10^3$ fibers/cm$^2$ (20,000 fibers/inch$^2$) or more, and is more preferably $4.7\times10^3$ fibers/cm$^2$ (30,000 fibers/inch$^2$) or more.

Examples of the materials for the cleaning blade 33 (scraper) include stainless steel (SUS), phosphorus bronze, and the like. In particular, because the cleaning roll 32 (cleaning roll 10 in the present exemplary embodiment) is configured to have a superior durability and slidability (abrasion resistance), the material for the cleaning blade 33 preferably has a hardness (as determined with a type A durometer specified in JIS K6253 (1997)) of A40 to A90, more preferably A50 to A85, and still more preferably A60 to A80.

The cleaning rolls 32 are placed at a position where the outer peripheral surface of the roll 32 bites into the outer peripheral surface of the brush members 31, and the cleaning rolls 32 are configured to hold the residual toner, external additives, and the like adhered to the brush members 31, and the residual toner, external additives and the like held on the surface of the cleaning rolls 32 are recovered by the cleaning blades 33 that are placed in contact with the cleaning rolls 32.

Cleaning voltages are applied to the brush members 31 and the cleaning rolls 32, respectively, and, for example, the cleaning voltages applied to the brush members 31 and the cleaning roll 32 are preferably different from each other. The residual toner, external additives and the like scraped from the surface of the electrophotographic photoreceptor 34, due to a mechanical shearing force and the potential difference, are transferred to the cleaning roll 32 electrostatically.

That is to say, by the electric field generated between the cleaning voltage-applied brush members 31 and the electrophotographic photoreceptor 34, the residual toner and the like is first pulled from the surface of the electrophotographic photoreceptor 34 toward the brush members 31 by electrostatic attraction, and is removed from the surface of the electrophotographic photoreceptor 34. Then, the cleaning rolls 32, to which a cleaning voltage of the same polarity but of a higher absolute value than that of the brush members 31 is applied, the residual toner, external additives and the like that have been adhered onto the brush members 31 are then re-adhered, this time onto the cleaning rolls 32.

The cleaning blade 33 (scrapers) are in contact with the cleaning rolls 32, and the toner and the like adhered onto the cleaning rolls 32 are removed from the cleaning rolls 32 with the cleaning blades 33 (hereinafter, referred to as "cleaning members"). The cleaning members are formed of, for example, a thin metal plate of stainless steel or phosphorus bronze, preferably, having a thickness in the range of approximately 0.02 mm to 2 mm, from the viewpoints of durability and low cost.

As described above, the cleaning unit 30 in the present exemplary embodiment attracts and transfers efficiently fine powders such as toner and paper dust electrostatically by the potential difference generated between the brush member 31 and the cleaning roll 32. The potential difference generated between the brush member 31 and the cleaning roll 32 is preferably 100 V or more, as an absolute value, and more preferably 200 V or more. However, the upper limit is approximately 600 V, in view of preventing the reversal of polarity of the object to be cleaned due to charge injection resulting from discharge between respective parts.

The cleaning unit 30 in the present exemplary embodiment may have multiple units along the moving direction of the electrophotographic photoreceptor 34, each unit at least having a brush member 31 placed in contact with the surface of the electrophotographic photoreceptor 34, a cleaning roll 32 placed in contact with the brush member 31, and a cleaning blade 33 placed in contact with the cleaning roll 32 (there are two such units in the present exemplary embodiment). When there are multiple such units, it is preferable that the voltages applied to respective units are of alternating polarities along the moving direction of the electrophotographic photoreceptor 34.

So-called post-transfer residual toner remaining on the surface of the electrophotographic photoreceptor 34 after the transfer process has been completed varies in polarity under the influence of the transfer electric field, and such remaining toner includes toner having a positive polarity and toner that has been reversed in polarity from positive to negative. It is possible to realize efficient cleaning of all the remaining toner, including the positive post-transfer residual toner and also the post-transfer residual toner having the reversed polarity, by installing multiple units for each of the electrophotographic photoreceptors 34, each of which unit including one of the brush members 31, one of the cleaning rolls 32 and one of the cleaning blades 33, and setting the units with potential differences of different polarities for the respective units.

Among the voltages applied to respective units installed in the cleaning unit 30 along the moving direction of the electrophotographic photoreceptor 34 in the present exemplary embodiment, the voltage applied to the unit disposed at the most upstream side in the moving direction of the electrophotographic photoreceptor 34 preferably has a polarity different from the polarity of the toner on the developer carrying surface.

The polarity of the so-called post-transfer residual toner remaining on the surface of the electrophotographic photoreceptor 34, after the transfer process has been completed, fluctuates under the influence of the transfer electric field as described above, but, for example, when the transfer voltage is positive, most of the toner remains positively charged. Cleaning voltages have the same polarity (positive) to the polarity of the post-transfer residual toner and which have a difference in potential between the brush member 31 and the cleaning roll 32 are applied to the brush member 31 and the cleaning roll 32 in the first unit placed at the most upstream side in the moving direction of the electrophotographic photoreceptor 34 so that positive polarity toner, which is most of the post-transfer residual toner, is electrostatically attracted and moved to the brush member 31 and to the cleaning roll 32, and cleaning voltages have the different polarity (negative) from the polarity of most of the post-transfer residual toner; and which have a difference in potential between the second brush member 31 and the second cleaning roll 32 are applied to the brush member 31 and the cleaning roll 32 in the subsequent second unit so that toner that has been reversed in polarity from that of most of the post-transfer residual toner, is electrostatically attracted and moved to the second brush member 31 and the second cleaning roll 32.

In the developing process with a negatively charged toner, it is preferable that the polarity applied to the first unit is a polarity (positive) that is different from the polarity of the toner on the developer carrying surface; and the voltage applied to the first unit preferably has a polarity different from the polarity of the toner on the developer carrying surface, and the voltages applied to the second unit, and subsequent units, are alternately of opposite polarity to those applied to the previous unit.

(Image-Forming Apparatus and Process Cartridge)

Figure 5:
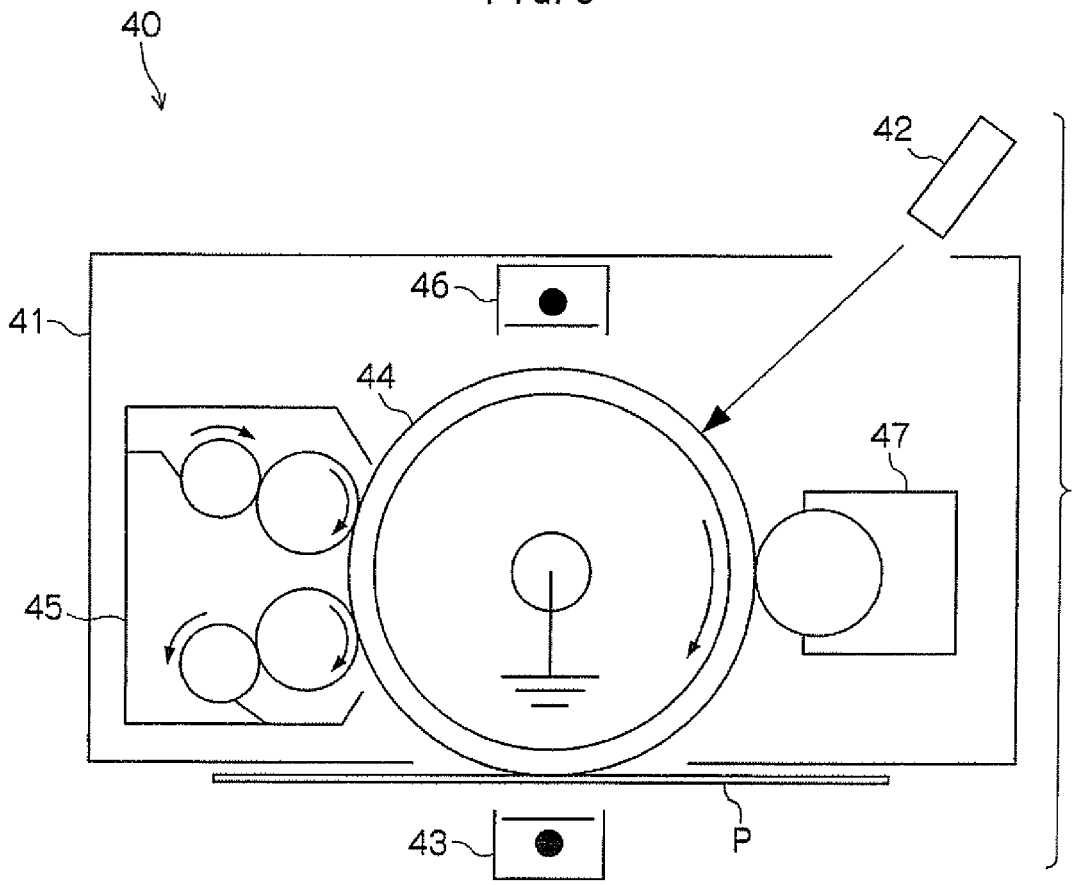
FIG. 5 is a schematic view illustrating the configuration of an image-forming apparatus in an exemplary embodiment.

FIG. 5 is a schematic view illustrating an image-forming apparatus in the present exemplary embodiment. The image-forming apparatus 40 in the present exemplary embodiment includes an image-forming apparatus main body (not shown in the figure), a process cartridge 41, an exposure device 42 (electrostatic latent image forming unit), and a transfer device 43 (transfer unit), as shown in FIG. 5. In the image-forming apparatus 50, the exposure device 42 is placed at a position where light exposure can be carried out through an opening in the process cartridge 41 onto the electrophotographic photoreceptor 44, and the transfer device 43 is arranged at a position facing the electrophotographic photoreceptor 44, with a recording medium P therebetween.

The process cartridge 41 is a unit including an electrophotographic photoreceptor 44 (image-holding member), a charging device 46 (charging unit), a developing device 47 (developing unit), and a cleaning unit 45 (toner-removing unit) integrated on a fixing rail in the case. An opening is provided in the case for carrying out exposure.

The cleaning unit 30 in the exemplary embodiment is provided as a cleaning unit 45. Thus in the image-forming apparatus (process cartridge) in the present exemplary embodiment, the toner and the external additive are removed from the electrophotographic photoreceptor and adhesion thereof onto the surface thereof is prevented over a long period of time without use of a cleaning blade system, so that high-quality images can be obtained. As a result, high durability and low running costs can be achieved. Such a cleaning unit, in contrast to rubber blades which have been used as a cleaning member, can easily be recycled with washing after use for a certain period, which will contribute to the saving of natural resources.

In the image-forming apparatus in the present exemplary embodiment, the surface of the electrophotographic photoreceptor 44 is charged by a charging device 46 (charging unit), an electrostatic latent image is formed on the charged electrophotographic photoreceptor 4 with image-wise exposure by an exposure device 42 such as a laser bean scanner. The electrostatic latent image formed is then developed to form a toner image with a developer stored in the developing device 47, and then, the toner image is transferred by the transfer device 43 onto the surface of the recording medium P. After transfer, the surface of the electrophotographic photoreceptor 44 is cleaned by the cleaning unit 45.

More specifically, the electrophotographic photoreceptor 44 is, for example, a negatively charged organic photoreceptor, which is charged negatively by the charging device 46. An electrostatic latent image is formed by image-wise exposure on the surface of tile electrophotographic photoreceptor 44 by being irradiated with a laser beam scanning from the exposure device 42, and the electrostatic latent image is then developed with a toner to form a visible image by a reversal development in the developing device 47. Thus, the image-wisely exposed electrostatic latent image is visualized with toner that has a negatively charged polarity that is the same as that of the negative charged polarity of the electrophotographic photoreceptor 44. The toner image thus formed is then transferred directly onto the recording medium P by the transfer device 43, and the transferred image is fixed on the recording medium P as the medium is heated under pressure while passing through a fixing unit (not shown), and then the medium P with a permanent image is discharged into a printed paper tray. After transfer, the surface of the electrophotographic photoreceptor 44 is cleaned by the cleaning unit 45.

The process cartridge 41 is detachably configured by combining some of the above components from the image-forming apparatus main body. The process cartridge 41 preferably is provided with at least an electrophotographic photoreceptor 44 and a cleaning unit 45, the process cartridge 41 is detached from the image-forming apparatus main body and replaced with a new one after the lifetime or the like of the electrophotographic photoreceptor 44.

In the process cartridge 41, the cleaning unit 45 may be detachable from the electrophotographic photoreceptor 44. In such a process cartridge 41, the lifetime of the cleaning unit 45 is generally longer than that of the electrophotographic photoreceptor 44, and thus, the process cartridge 41 may be used repeatedly after only the electrophotographic photoreceptor 44 is replaced. A maintenance-free system can be achieved by using the cleaning unit 45 as a single process cartridge and high-quality image formation can be repeatedly achieved easily only by replacement of the process cartridge.

Figure 6:
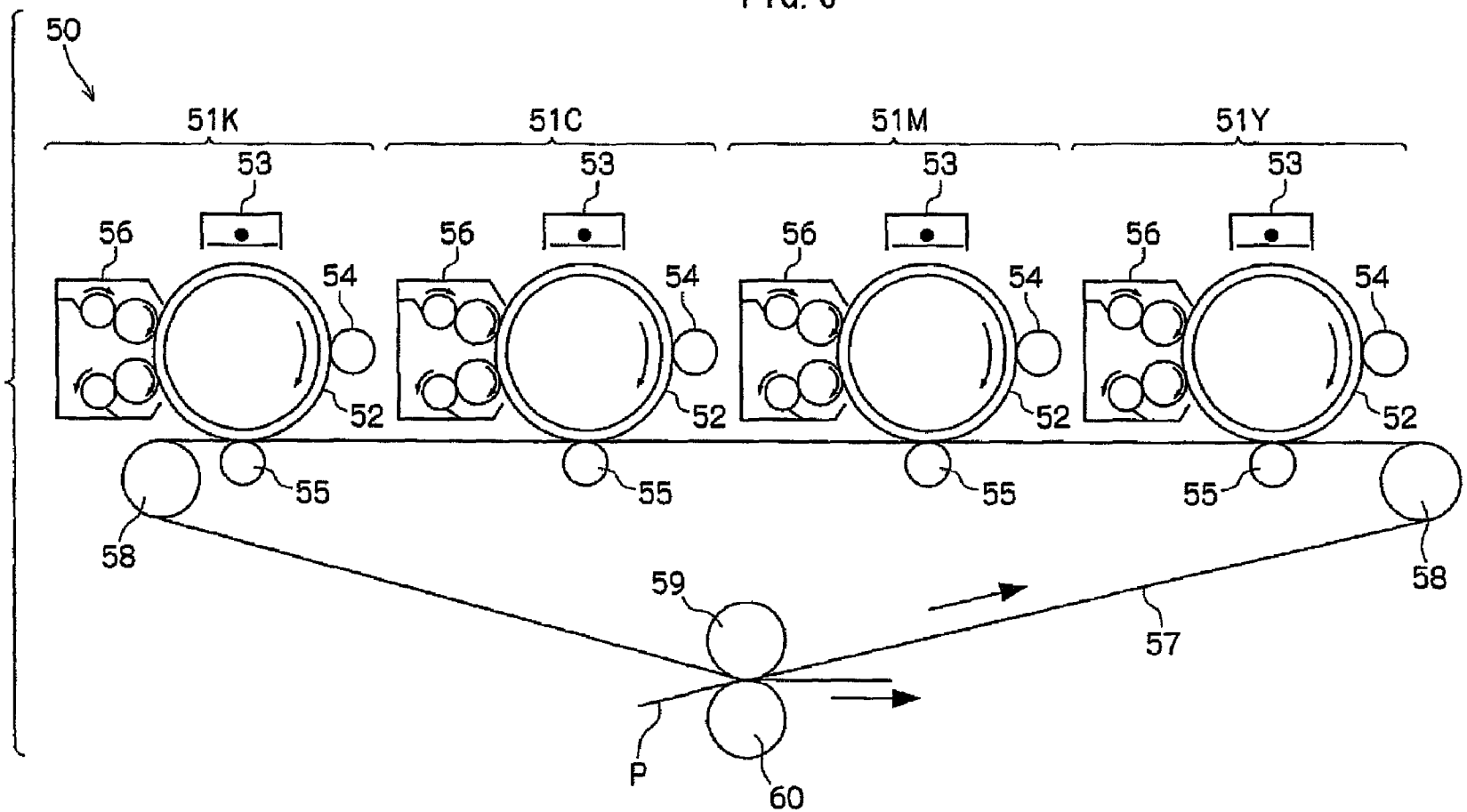
FIG. 6 is a schematic view illustrating the configuration of an image-forming apparatus in another exemplary embodiment.

FIG. 6 is a schematic view illustrating the configuration of an image-forming apparatus in another exemplary embodiment. The image-forming apparatus in this exemplary embodiment is a tandem color image-forming apparatus. The tandem color image-forming apparatus is an image-forming apparatus having two or more photoreceptors.

As shown in FIG. 6, the image-forming apparatus 50 in the other exemplary embodiment is a tandem color image-forming apparatus having four image-forming apparatus units 51Y, 51M, 51C, and 51K disposed sequentially in this order for forming, respectively, color toner images of yellow (Y), magenta (M), cyan (C), and black (K) colors. The tandem color image-forming apparatus is configured such that an intermediate transfer belt 57 passes through a transfer section of each image-forming unit (transfer section photoreceptor drum). Similarly to the image-forming apparatus shown in FIG. 5, each of the image-forming units 51Y, 51M, 51C, and 51K has an electrophotographic photoreceptor 52 that rotates in the arrow direction, a charging device 53, a developing device 54, a primary transfer roll (primary transfer member) 55, a cleaning unit 56, and the like are arranged in the clockwise direction in this order at the periphery of the electrophotographic photoreceptor 52. The intermediate transfer belt 57 is entrained with a stretch around two supporting rolls 58 and a back roll 59, such that the transfer belt 57 rotates in the arrow direction in contact with the transfer unit of each image-forming unit 51Y, 51M, 51C, and 51K. Changes in belt peripheral length can be adjusted by changing the position of the back roll 59.

In the image-forming apparatus 50 in the other exemplary embodiment, the toner image with respective colors superposed on the surface of the intermediate transfer belt 57 is transferred onto the surface of the recording medium P by the secondary transfer roll 60 at the position of the back roll 59. The toner image on the surface of the recording medium P is then fixed to form a color image by feeding the recording medium P to a fixing device (not shown).

In the image-forming apparatus 50 in the other exemplary embodiment, the conductive roll used as the cleaning roll 10 in the aforementioned exemplary embodiment is used for the primary transfer roll 55, the supporting roll 58, and the back roll 59, and the cleaning unit 30 in the aforementioned exemplary embodiment is used for the cleaning unit 56.

Further, a conductive resin belt or a conductive rubber belt is used as the intermediate transfer belt 57, but a resin intermediate transfer belt with a high modulus of elasticity, which does not stretch much, is preferable for the purpose of register of the color images.

A tandem image-forming apparatus 50, such as the image-forming apparatus in the other exemplary embodiment, enables high-speed image formation, but, on the other hand, the electrophotographic photoreceptor 52 is prone to high wear, and methods for cleaning the electrophotographic photoreceptor have been technical problems to be solved. In this connection, the image-forming apparatus 50 in the other exemplary embodiment is provided with a multiple cleaning unit 56 for each electrophotographic photoreceptor 52, even in a so-called tandem image-forming apparatus having plural electrophotographic photoreceptors 52. In such a configuration, it is possible to reduce wear of the surface of the electrophotographic photoreceptor and retain its cleaning efficiency reliably even in a high-speed image formation.

EXAMPLES

Hereinafter, the invention will be described specifically with reference to Examples, but it should be understood that the invention is not limited to these Examples.

Example 1

Preparation of Conductive Roll

Six parts by weight of acid processed dry carbon black (SPECIAL BLACK4 (trade name, manufactured by Degussa, pH: 3.0, volatile component: 14.0%, hereinafter referred to as "CB") is added to 100 parts by weight of N-methyl-2-pyrrolidone (hereinafter, referred to as "NMP"), and the mixture is divided into two portions and then, in a collision dispersing machine (trade name: Geanus PY; manufactured by Geanus), the portions are collide with each other in the region of a minimum area of 1.4 $mm^2$ at a pressure of 200 MPa and the mixture is then divided again into two portions. This procedure is repeated five times to prepare a CB/NMP dispersion.

15.6 pails by weight of 4,4'-diphenylmethanebismaleimide (hereinafter, referred to as "BMI") as a bismaleimide compound and 4.4 parts by weight of 4,4'-diaminodiphenylmethane (hereinafter, referred to as "DDM") as a diamine compound are dissolved in the CB/NMP fluid dispersion to form a coating solution (A). The liquid viscosity of the coating solution (A) obtained is 200 poises.

Then, the coating solution (A) is coated to a thickness of 500 μm on a stainless steel (SUS) core cylinder having an external diameter of 12 mm, as the coating solution (A) is supplied at a particular rate from a container 22 containing the coating solution while the container is moved at a speed of 200 mm/min, and the core cylinder having an external diameter of 12 mm is rotated at a speed of 200 rpm in the coating machine shown in FIG. 3. Thereafter, the cylinder is heated at 120° C. for 60 minutes and then cooled to room temperature, while the cylinder is rotated at a speed of 10 rpm. The cylinder is then heated to 250° C. at a heating rate of 2° C./minute and further heated at 250° C. for 30 minutes, so that the solvent is removed and the polymerization reaction is completed. The thickness of the CB/bismaleimide resin layer (coating layer) is 100±5 μm.

The electric resistance of the conductive roll and the volume resistivity of the conductive roll in the peripheral direction are determined in the following manner:

(Electric Resistance of Conductive Roll)

The electric resistance of the conductive roll obtained is determined by placing the conductive roll on the surface of a copper plate with a load of 500 g applied on both ends of the roll, measuring the current value (I) at 10 seconds after application of a voltage (V) of 500 V between the core cylinder of the conductive roll and the metal plate in an environment of 25° C. and 70% RH by using a micro electric current analyzer (trade name, R8320, manufactured by Advantest), and calculating the resistant value according to Formula: R=V/I (Ω). The resistance obtained is $1\times10^8\Omega$.

The electric resistance of all conductive rolls in the following Examples and Comparative Examples is determined by the above-mentioned method.

(Fluctuation in Volume Resistivity of Conductive Roll in the Peripheral Direction of Conductive Roll)

The fluctuation in volume electric resistivity of a conductive roll in the peripheral direction of the conductive roll is determined at 12 positions on the surface of the conductive roll separated from each other at an angle of 30° in the circumferential direction by using a Hiresta UP MCP-HT450 (trade name, manufactured by Dia Instruments Co., Ltd.). Then, the volume resistivity at each measurement position is determined at 10 seconds after application of a voltage (V) of 500 V in an environment of 25° C. and 70% RH by using an electrode probe of UR-SS (trade name, manufactured by Dia Instruments Co., Ltd.) and calculating the current value (I).

The average, the maximum, and the minimum common logarithm (Log Ω.cm) of the volume resistivities are determined, and the fluctuation in volume resistivity in the peripheral direction is determined from the values of (maximum value-average value) and (average value-minimum value). The results of the volume resistivity is ±0.1 (Log Ω.cm).

In all of the following Examples and Comparative Examples, the fluctuation in volume resistivity of the conductive roll in the peripheral direction is determined by the above-mentioned method.

(Evaluation 1)

A process cartridge including an electrophotographic photoreceptor shown below and two cleaning units each having a brush member, the conductive roll and a scraper (see FIG. 4) is installed in a black and white image-forming apparatus shown in FIG. 5 (printing speed: 50 sheets/minute, A4 sized paper, long-edge-feed), and subjected to a 1,000,000 sheet-image-forming test. The developer used in the image-forming apparatus is a styrene-based toner (volume average particle diameter: 9.0 μm, external additive: mixture of silica, titania and Mn/Mg/Sr ferrite carrier, and negatively charged).

After the black and white image-forming test, there is no image defect due to insufficient cleaning even on the 1,000,000 th sheet image. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $1\times10^8\Omega$, the fluctuation in the volume resistivity in the peripheral direction of the conductive roll is ±0.1 (Log Ω.cm), and the wear loss is only approximately 0.1 μm in external diameter of the conductive roll. There are no particular apparent changes or scrapes observed to either of the scrapers at all.

In addition, a 600,000-sheet image forming test is performed in a similar manner to the case when the black and white image-forming apparatus is used, except that the tandem full-color image-forming apparatus shown in FIG. 6 (printing speed: 60 sheets/minute, A4 size sheet, long-edge-feed) is used.

After the color image-forming test, there is no image defect due to insufficient cleaning even in the 600,000th sheet image. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $1\times10^8\Omega$, the fluctuation in the volume resistivity in the peripheral direction of the conductive roll is ±0.1 (Log Ω.cm), and the wear loss is only approximately 0.1 μm in external diameter of the conductive roll. There are no particular apparent changes or scrapes observed to either of the scrapers at all.

The process cartridge is configured in the following manner:

(Electrophotographic Photoreceptor)

An electrophotographic photoreceptor is prepared in the following manner.

(Preparation of Undercoat Layer)

100 parts by weight of zinc oxide (average particle diameter: 70 nm, manufactured by Tayca Corporation, specific surface area: 15 $m^2/g$) is mixed and stirred with 500 parts by weight of tetrahydrofuran, and 1.3 parts by weight of a silane-coupling agent (trade name: KBM503, manufactured by Shin-Etsu Chemical Co., Ltd.) is added thereto, and the mixture is stirred for 2 hours. Toluene is then distilled away under reduced pressure, and the residue is baked at 120° C. for 3 hours, to obtain zinc oxide surface-treated with the silane-coupling agent.

110 pails by weight of the surface-treated zinc oxide is mixed and stilled with 500 parts by weight of tetrahydrofuran; a solution of 0.6 part by weight of alizarin dissolved in 50 parts by weight of tetrahydrofuran is added thereto, and the mixture is stirred at 50° C. for 5 hours. Then, alizarin is added to the zinc oxide and the alizarin-added zinc oxide is separated by filtration under reduced pressure and dried at 60° C. under reduced pressure to obtain the alizarin-added zinc oxide.

38 parts by weight of a solution containing 60 parts by weight of the alizarin-added zinc oxide, 13.5 parts by weight of a hardener (blocked isocyanate, trade name Sumidur 3175, manufactured by Sumitomo Bayer Urethane Co.), and 15 parts by weight of a butyral resin (trade name; S-LEC BM-1, manufactured by Sekisui Chemical Co.) dissolved in 85 parts by weight methylethylketone, is mixed with 25 parts by weight of methylethylketone, and the mixture is dispersed in a sand mill by using 1 mm diameter glass beads for 2 hours to obtain a dispersion.

0.005 part by weight of dioctyltin dilaurate as a catalyst and 40 parts by weight of silicone resin particles (trade name: Tospearl 145, manufactured by GE Toshiba Silicones) are added to the obtained dispersion, to provide the coating solution for an undercoat layer The coating solution is coated on an aluminum substrate of 30 mm in diameter, 340 mm in length, and 1 mm in thickness by a dip coating method, and dried and hardened at 170° C. for 40 minutes to obtain an undercoat layer having a thickness of 18 μm.

(Preparation of Charge-Generating Layer)

A mixture of 15 parts by weight of hydroxygallium phthalocyanine as a charge-generating substance having diffraction peaks at Bragg angles (2θ±0.2°) of at least at the positions of 7.3°, 16.0°, 24.9°, and 28.0° in the X-ray diffraction spectrum obtained by using CuKα X ray, 10 parts by weight of vinyl chloride-vinyl acetate copolymer resin (trade name: VMCH, manufactured by Nippon Unicar Co., Ltd.) as a binder resin, and 200 parts by weight of n-butyl acetate is dispersed in a sand mill by using glass beads having a diameter of 1 mm for 4 hours. 175 parts by weight of n-butyl acetate and 180 parts by weight of methylethylketone are added to and stirred with the obtained dispersion to provide the coating solution for a charge-generating layer. The coating solution for the charge-generating layer is dip-coated on the undercoat layer and dried at room temperature (25° C.) to form a charge-generating layer having a thickness of 0.2 μm.

(Preparation of Charge-Transport Layer)

45 parts by weight of N,N'-diphenyl-N,N'-bis(3-methylphenyl)-[1,1']biphenyl-4,4'-diamine and 55 parts by weight of a bisphenol Z polycarbonate resin (viscosity-average molecular weight: 40,000) are added to and dissolved in 800 parts by weight of chlorobenzene to give a coating solution for a charge-transport layer of the photoreceptor. The coating solution is coated on the charge-generating layer and dried at 130° C. for 45 minutes to form a charge-transport layer having a thickness of 30 μm.

(Cleaning Unit)

(First Unit)

(Brush Member)

Material: conductive nylon (fineness: 2 deniers (17 μm))
Electric resistance: $1\times10^5\Omega$
Fiber length: 4 mm
Density: $7.8\times10^3$ fibers/$cm^2$ (50,000 fibers/$inch^2$)
Contact depth (bite) of photoreceptor: 1.5 mm
Peripheral speed: 60 mm/s
Rotation direction: opposite to the photoreceptor rotation direction
Brush applied voltage: +200 V (Conductive Roll)

Material: metal core cylinder with bismaleimide resin-coated layer having a thickness of 100 μm
Electric resistance: $1\times10^8\Omega$
Wear loss: 4 mg
Contact depth into brush: 1.5 mm
Peripheral speed: 70 mm/s
Applied voltage: +600 V (Scraper)

Material: Stainless steel (SUS304)
Thickness: 80 μm
Contact depth: 1.3 mm
Free length: 8.0 mm (Second Unit)

(Brush Member)

Material: conductive nylon (fineness: 2 deniers (17 μm))
Electric resistance: $1\times10^5\Omega$
Fiber length: 4 mm
Density: $7.8\times10^3$ fibers/$cm^2$ (50,000 fibers/$inch^2$)
Contact depth of photoreceptor: 1.5 mm
Peripheral speed: 60 mm/s
Rotation direction: opposite to photoreceptor rotation direction
Applied voltage to brush: −400 V (Conductive Roll)

Material: bismaleimide resin-coated metal core cylinder having a thickness of 100 μm
Electric resistance: $1\times10^8\Omega$
Wear loss: 2 mg
Contact depth into brush: 1.5 mm
Peripheral speed: 70 mm/s
Applied voltage: −800 V (Scraper)

Material: Stainless steel (SUS304)
Thickness: 80 μm
Contact depth: 1.3 mm
Free length: 8.0 mm

Example 2

A conductive roll is prepared in a similar manner to Example 1, except that the blending amounts of BMI and DDM in the preparation of the conductive roll of Example 1 are changed respectively to 12.8 parts by weight and 7.2 parts by weight. The following process cartridge is prepared and evaluated in a similar manner to Example 1.

After the black and white image-forming test, there is no image defect due to insufficient cleaning even on the 1,000,000 th sheet image. There is no sharp scratch on the photoreceptor surface, which results in a defected print image, and also no toner filming. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $1\times10^8\Omega$, the fluctuation in the volume resistivity in the peripheral direction of the conductive roll is ±0.1 (Log Ω.cm), and the wear loss is only approximately 0.1 μm in external diameter of the conductive roll. There are no particular apparent changes or scrapes observed to either of the scrapers at all.

After the color image-forming test, there is no image defect due to insufficient cleaning even in the 600,000 th sheet image. No shape scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $1\times10^8\Omega$, the fluctuation in the volume resistivity in the peripheral direction of the conductive roll is ±0.1 (Log Ω.cm), and the wear loss is only approximately 0.5 μm in external diameter of the conductive roll. There are no particular apparent changes or scrapes observed to either of the scrapers at all.

The process cartridge is configured in the following manner:

(Electrophotographic Photoreceptor)

An electrophotographic photoreceptor is the same as that of Example 1.

(Cleaning Unit)

(First Unit)

(Brush)

Material: conductive nylon (fineness: 2 deniers (17 μm))

Electric resistance: $1\times10^5\Omega$

Fiber length: 4 mm

Density: $7.8\times10^3$ fibers/cm$^2$ (50,000 fibers/inch$^2$)

Contact depth of photoreceptor: 1.5 mm

Peripheral speed: 60 mm/s

Rotation direction: opposite to photoreceptor rotation direction

Applied voltage to brush: +200 V (Conductive Roll)

Material: Metal core cylinder with a bismaleimide resin-coated layer having a thickness of 100 μm Electric resistance: $1\times10^8\Omega$ Wear loss: 2 mg Contact depth into brush: 1.5 mm Peripheral speed: 70 mm/s Applied voltage: +600 V (Scraper)

Material: Stainless steel (SUS304)

Thickness: 80 μm

Contact depth: 1.3 mm

Free length: 8.0 mm (Second Unit)

(Brush Member)

Material: conductive nylon (fineness: 2 deniers (17 μm))

Electric resistance: $1\times10^5\Omega$

Fiber length: 4 mm

Density: $7.8\times10^3$ fibers/cm$^2$ (50,000 fibers/inch$^2$)

Contact depth of photoreceptor: 1.5 mm

Peripheral speed: 60 mm/s

Rotation direction: opposite to photoreceptor rotation direction

Applied voltage to brush: −400 V (Conductive Roll)

Material: Metal core cylinder with a bismaleimide resin-coated layer having a thickness of 100 μm Electric resistance: $1\times10^8\Omega$ Wear loss: 2 mg Contact depth into brush: 1.5 mm Peripheral speed: 70 mm/s Applied voltage: −800 V (Scraper)

Material: Stainless steel (SUS304)

Thickness: 80 μm

Contact depth: 1.3 mm

Free length: 8.0 mm

Example 3

A conductive roll is prepared in a similar manner to Example 1, except that the blending amounts of BMI and DDM in preparation of the conductive roll of Example 1 are changed respectively to 17.5 parts by weight and 2.5 parts by weight. A process cartridge similar to that in Example 2 is prepared and evaluated in a similar manner to Example 1.

After the black and white image-forming test, there is no image defect due to insufficient cleaning even on the 1,000,000 th sheet image. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $1\times10^8\Omega$, the fluctuation in the volume resistivity in the peripheral direction of the conductive roll is ±0.1 (Log Ω.cm), and the wear loss is only approximately 0.1 μm in external diameter of the conductive roll. There are no particular apparent changes or scrapes observed to either of the scrapers at all.

After the color image-forming test, there is no image defect due to insufficient cleaning even in the 600,000 th sheet image. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $5\times10^8\Omega$, the fluctuation in the volume resistivity in the peripheral direction of the conductive roll is ±0.1 (Log Ω.cm), and the wear loss is only approximately 0.2 μm in external diameter of the conductive roll. There are no particular apparent changes or scrapes observed to either of the scrapers at all.

The process cartridge is configured in the following manner:

(Electrophotographic Photoreceptor)

An electrophotographic photoreceptor is the same as that of Example 1.

(Cleaning Unit)

(First Unit)

(Brush)

Material: conductive nylon (fineness: 2 deniers (17 μm))

Electric resistance: $1\times10^5\Omega$

Fiber length: 4 mm

Density: $7.8\times10^3$ fibers/cm$^2$ (50,000 fibers/inch$^2$)

Contact depth of photoreceptor: 1.5 mm

Peripheral speed: 60 mm/s

Rotation direction: opposite to photoreceptor rotation direction

Applied voltage to brush: +200 V (Conductive Roll)

Material: Metal core cylinder with bismaleimide resin-coated layer having a thickness of 100 μm Electric resistance: $1\times10^8\Omega$ Wear loss: 2 mg Contact depth into brush: 1.5 mm Peripheral speed: 70 mm/s Applied voltage: +600 V (Scraper)

Material: Stainless steel (SUS304)

Thickness: 80 mm

Contact depth: 1.3 mm

Free length: 8.0 mm (Second Unit)

(Brush Member)

Material: conductive nylon (fineness: 2 deniers (17 μm))

Electric resistance: $1\times10^5\Omega$

Fiber length: 4 mm

Density: $7.8\times10^3$ fibers/cm$^2$ (50,000 fibers/inch$^2$)

Contact depth of photoreceptor: 1.5 mm

Peripheral speed: 60 mm/s

Rotation direction: opposite to photoreceptor rotation direction

Applied voltage to brush: −400 V (Conductive Roll)

Material: metal core cylinder with bismaleimide resin-coated layer having a thickness of 100 μm Electric resistance: $1\times10^8\Omega$ Wear loss: 2 mg Contact depth into brush: 1.5 mm Peripheral speed: 70 mm/s Applied voltage: −800 V (Scraper)

Material: Stainless steel (SUS304)

Thickness: 80 μm

Contact depth: 1.3 mm

Free length: 8.0 mm

Example 4

A conductive roll is prepared in a similar manner to Example 1, except that BMI is replaced with 16.1 parts by weight of 4,4'-methylene bis(cyclohexylmaleimide) and DDM is replaced with 4.7 parts by weight of 4,4'-methylene bis(cyclohexylamine). The following process cartridge is prepared.

The process cartridge is configured in the following manner:

(Electrophotographic Photoreceptor)

An electrophotographic photoreceptor is the same as that of Example 1.

(Cleaning Unit)

(First Unit)

(Brush)

Material: conductive nylon (fineness: 2 deniers (17 μm))

Electric resistance: $1\times10^5\Omega$

Fiber length: 4 mm

Density: $7.8\times10^3$ fibers/cm$^2$ (50,000 fibers/inch$^2$)

Contact depth of photoreceptor: 1.5 mm

Peripheral speed: 60 mm/s

Rotation direction: opposite to photoreceptor rotation direction

Applied voltage to brush: +200 V (Conductive Roll)

Material: Metal core cylinder with bismaleimide resin-coated layer having a thickness of 100 μM Electric resistance. $1\times10^8\Omega$ Wear loss: 2 mg Contact depth into brush: 1.5 mm Peripheral speed: 70 mm/s Applied voltage: +600 V (Scraper)

Material: Stainless steel (SUS304)

Thickness: 80 mm

Contact depth: 1.3 mm

Free length: 8.0 mm (Second Unit)

(Brush Member)

Material: conductive nylon (fineness: 2 deniers (17 μm))

Electric resistance: $1\times10^5\Omega$

Fiber length: 4 mm

Density: $7.8\times10^3$ fibers/cm$^2$ (50,000 fibers/inch$^2$)

Contact depth of photoreceptor: 1.5 mm

Peripheral speed: 60 mm/s

Rotation direction: opposite to photoreceptor rotation direction

Brush applied voltage: −400 V (Conductive Roll)

Material: Metal core cylinder with bismaleimide resin-coated layer having a thickness of 100 μm Electric resistance: $1\times10^8\Omega$ Wear loss: 2 mg Contact depth into brush: 1.5 mm Peripheral speed: 70 mm/s Applied voltage: −800 V (Scraper)

Material: Stainless steel (SUS304)

Thickness; 80 μm

Contact depth: 1.3 mm

Free length: 8.0 mm

The conductive roll is evaluated in a similar manner to Example 1.

After the black and white image-forming test, there is no image defect due to insufficient cleaning even on the 1,000,000 th sheet image. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $1\times10^8\Omega$, the fluctuation in the volume resistivity in the peripheral direction of the conductive roll is ±0.1 (Log Ω.cm), and the wear loss is only approximately 1.0 μm in external diameter of the conductive roll. There are no particular apparent changes or scrapes observed to either of the scrapers at all.

After the color image-forming test, there is no image defect due to insufficient cleaning even in the 600,000 th sheet image. No sharp scratches appear on the photoreceptor surface, which would cause defective print images, and also no toner filming occurs. There is no build-up of toner on either of the brush members observed, nor permanent bend of the bristles observed, and there is no particularly large apparent change of the conductive rolls observed. The electric resistance is $5\times10^8\Omega$ the fluctuation in the volume resistivity in the peripheral direction of the conductive roll is ±0.1 (Log Ω.cm), and the wear loss is only approximately 1.0 μm in external diameter of the conductive roll. There are no particular apparent chances or scrapes observed to either of the scrapers at all.

Comparative Example 1

20 pairs by weight of CB is added to and mixed with 100 parts by weight of a phenol resin SUMIRESIN EXCEL CRP-3900 (trade name, manufactured by Sumitomo Bakelite), to give a coating solution (X). The coating solution X is coated on a Stainless steel (SUS) core cylinder, similarly to Example 1. The coating solution on the cylinder is heated and hardened at 150° C. for 30 minutes, to give a predetermined conductive roll.

The thickness of the phenol resin layer on the conductive roll obtained is 2.0 mm slightly thicker than that in the Example above. The electric resistance of the conductive roll obtained is $1\times10^8\Omega$ when a voltage of 500 V is applied, and the fluctuation in the volume resistivity in the roll peripheral direction is ±2.0 (Log Ω.cm).

The conductive roll is evaluated in a similar manner to Example 1.

After the black and white image-forming test, there are image defects due to insufficient cleaning in the 100,000 th sheet image. There are also sharp scratches on the surface of the photoreceptor, which result in defective print images, and there is also toner filming. In addition, build-up toner on both of the brush members and permanent bend in the bristles is observed and the electric resistance is $1\times10^6\Omega$, the fluctuation in the volume resistivity in the peripheral direction of the conductive roll is ±3.0 (Log Ω.cm), and the wear loss is approximately 50 μm in external diameter of both of the conductive rolls.

After the color image-forming test, there are image defects due to insufficient cleaning in the 600,000 th sheet image. There are sharp scratches on the surface of the photoreceptor, which results in a defected print image, and there is also toner filming. In addition, build-up toner on both of the brush members and permanent bend in the bristles is observed and the electric resistance is $1\times10^6\Omega$, the fluctuation in the volume resistivity in the peripheral direction of the conductive roll is ±3.0 (Log Ω.cm), and the wear loss is approximately 50 μm in external diameter of both of the conductive rolls.

Comparative Example 2

Preparation of Conductive Roll 30 parts by weigh of dry oxidation treated carbon black (SPECIAL BLACK4 (trade name, manufactured by Degussa, pH: 3.0, volatile component: 14.0%)) is added to a solution of a polyamide acid composed of 3,3',4,4'-biphenyl tracarboxylic dianhydride (BPDA) and p-phenylenediamine (PDA) in N-methyl-2 pyrrolidone AMP) solution (trade name: U-VARNISH-S, manufactured by Ube Industries, Ltd. (solid content: 18% by weight)) with respect to 100 parts by weight of the polyimide resin solid content. The mixture is divided into two portions, and then, in a collision dispersing machine (trade name: Geanus PY, manufactured by Geanus), the portions are collide with each other at a pressure of 200 MPa at a minimum area of 1.4 $mm^2$, and the resulting dispersion is divided again into two portions. This procedure is repeated five times to prepare a coating solution (Y). The liquid viscosity of the coating solution (Y) is 400 poises.

The coating solution (A) is coated on a stainless steel (SUS) core cylinder having an external diameter of 12 mm to a thickness of 0.3 mm, as the coating solution (A) is supplied at a predetermined rate from a container 22 containing the coating solution while the container is moved at a speed of 200 mm/min, and the core cylinder having an external diameter of 12 mm is rotated at a speed of 200 rpm in the coating machine shown in FIG. 3. Thereafter, the cylinder is heated at 120° C. for 60 minutes and then cooled to room temperature, while the cylinder is rotated at a speed of 10 rpm. The cylinder is then heated to 320° C. at a heating rate of 2° C./minute and further heated at 320° C. for 30 minutes, so that the solvent is removed, dehydration and ring-closure water are removed, and the imide conversion reaction is completed. The thickness of the polyimide resin layer is 0.06 mm. The electric resistance of the conductive roll is $2\times10^8\Omega$, the fluctuation in the volume resistivity in the peripheral direction of the conductive roll is ±0.1 (Log Ω.cm), The conductive roll is evaluated in a similar manner to Example 1.

After the black and white image-forming test, there are no image defects due to insufficient cleaning in the 200,000 th sheet image, but there are image defects due to insufficient cleaning even in the 1,000,000 th sheet image. There are no sharp scratches on the surface of the photoreceptor, which may result in a defected print image, and there is also no toner filming. However, slight build-up toner on the brush member and permanent bend to the bristles are observed. The electric resistance is $1\times10^7\Omega$, the fluctuation in the volume resistivity in the peripheral direction of the conductive roll is ±0.5 (Log Ω.cm), and the wear loss is approximately 0.5 μm in external diameter of the conductive roll. There are no particular apparent changes of or scrapes on either of the scrapers observed.

After the color image-forming test, there are image defects due to insufficient cleaning in the 600,000 th sheet image. There are deep sharp scratches on the surface of the photoreceptor, which result in defective print images, and there is also toner filming. In addition, build-up toner on both of the brush members and permanent bend of bristles are observed. The electric resistance is $1\times10^6\Omega$, the fluctuation in the volume resistivity in the peripheral direction of the conductive roll is ±3.0 (Log Ω.cm), and the wear loss is approximately 10 μm in external diameter of the conductive roll.

(Evaluation 2)

The conductive rolls obtained in each of the Examples and Comparative Examples are evaluated in the following tests.

(Durability)

The conductive roll is rotated (for 48 hours) in the state where the photoreceptor is detached from the cleaning unit (first unit) and no electric charge is applied, and only the brush member is brought into contact with the conductive roll in the cleaning unit (first unit) described above. The durability of the conductive roll is determined by measuring the difference in film thickness before the operation and after the operation (thickness before operation—thickness after operation).

(Cleaning Unit)

(First Unit)

(Brush Member)

Material: conductive nylon (fineness: 2 deniers (17 μm))

Fiber length: 4 mm

Density: $7.8\times10^3$ fibers/$cm^2$ (50,000 fibers/$inch^2$)

(Conductive Roll)

Material: resin-coated metal core cylinder

Contact depth into brush: 1.5 mm

Peripheral speed: 70 min/s (Scraper)

Material: Stainless steel (SUS304)

Contact depth: 1.3 mm

Free length: 8.0 mm (Environmental Fluctuation in Volume Resistivity)

The volume resistivity of the respective conductive roll coating layer thus obtained is determined by using Hiresta UP MCP-HT450 (trade name, manufactured by Dia Instruments Co., Ltd.). The volume resistivity between the coated-layer surface and the metal shaft is determined with a UR-SS as an electrode probe. The environmental fluctuation in volume resistivity is defined as the absolute value of the difference between common logarithms (Log Ω.cm) of the volume resistivities under high-temperature and high-humidity environment (28° C. and 85 RH %) and low-temperature and low-humidity environment (10° C. and 15 RH %).

Applied voltage: determined at 10 seconds after application of 500 V

Measurement environment: high-temperature and high-humidity environment (28° C. and 85 RH %) or low-temperature and low-humidity environment (10° C. and 15 RHs %)

(Fluctuation in Volume Resistivity by Current Supply)

An overvoltage (DC 1,000 V: 2 seconds) is applied to each of the conductive rolls obtained in a current-supply durability test. The volume resistance of the coated layer before and after current-supply durability test is determined by using a Hiresta UP MCP-HT450 (trade name, manufactured by Dia Instruments Co., Ltd.), and the resistance between the coated layer surface and the metal shaft is determined with a UR-SS as an electrode probe. The fluctuation in resistivity by current supply is defined as the difference between the common logarithms (Log Ω.cm) of the volume resistivities before and after the current-supply test.

(Slidability)

The slidability of each of the surface of conductive rolls obtained is evaluated by measuring the static friction coefficient by using a surface friction meter (HEIDON Tribogear Muse 94i). The conductive roll is divided at five locations at the equal intervals from the both ends to the center of the roll, and the average of the static friction coefficients of the five regions, as determined by using a surface friction meter (HEIDON Tribogear Muse 94i), is used as the static friction coefficient of the conductive roll.

TABLE 1

| | Example 1 | Example 2 | Example 3 | Example 4 | Comparative Example 1 | Comparative Example 2 |
|---|---|---|---|---|---|---|
| Durability (thickness before operation − thickness after operation): μm | −0.1 | −0.1 | −0.1 | −0.2 | −10.0 | −5.0 |
| Environmental fluctuation in volume resistivity (absolute value): (LogΩ · cm) | 0.1 | 0.1 | 0.1 | 0.3 | 2.0 | 0.5 |
| Fluctuation in volume resistivity by current supply (volume resistivity after current supply − volume resistivity before current supply): (LogΩ · cm) | −1.0 | −1.0 | −1.0 | −1.5 | −5.0 | −3.0 |
| slidability (surface static friction coefficient) | 0.10 | 0.15 | 0.15 | 0.20 | 0.50 | 0.30 |

The results above indicate that the conductive rolls of Examples have superior durability, fluctuation resistance to environment and current supply, and slidability, compared to those obtained in Comparative Examples. The conductive rolls of Examples 1 to 3 prepared with an aromatic monomer component have superior durability, fluctuation resistance in the volume resistivity to environment and current supply, and slidability as compared to those of Example 4 prepared by using an aliphatic monomer component.

The invention includes the following exemplary embodiments;

(1) A first aspect of the invention is a conductive roll, including a core and a coating layer containing a bismaleimide resin and a conductive agent, the coating layer being formed on the external peripheral surface of the core.

(2) A second aspect of the invention is the conductive roll of the above (1), wherein the bismaleimide resin is a copolymer of a bismaleimide and an amine compound.

(3) A third aspect of the invention is the conductive roll of the above (1), wherein the bismaleimide resin is a copolymer of an aromatic bismaleimide and an aromatic amine compound.

(4) A fourth aspect of the invention is a cleaning roll, including the conductive roll of any one of the above aspects (1) to (3).

(5) A fifth aspect of the invention is a cleaning roll, including the conductive roll of the above (2).

(6) A sixth aspect of the invention is a cleaning roll, including the conductive roll of the above (3).

(7) A seventh aspect of the invention is a cleaning unit, including at least a brush member, a conductive roll placed in contact with the brush member, and a blade placed in contact with the conductive roll, wherein the conductive roll is the conductive roll of any one of the above (1) to (3).

(8) A eight aspect of the invention is a cleaning unit, including at least a brush member, a conductive roll placed in contact with the brush member, and a blade placed in contact with the conductive roll, wherein the conductive roll is the conductive roll of the above (2).

(9) A ninth aspect of the invention is a cleaning unit, including at least a brush member, a conductive roll placed in contact with the brush member, and a blade placed in contact with the conductive roll, wherein the conductive roll is the conductive roll of the above (3).

(10) A tenth aspect of the invention is a process cartridge, including at least an image-holding member and a toner-removing unit for removing the toner remaining on the surface of the image-holding member, wherein the toner-removing unit includes the conductive roll of any one of the above (1) to (3).

(11) A eleventh aspect of the invention is a process cartridge, including at least an image-holding member and a toner-removing unit for removing the toner remaining on the surface of the image-holding member, wherein the toner-removing unit includes the conductive roll of the above (2).

(12) A twelfth aspect of the invention is process cartridge, including at least an image-holding member and a toner-removing unit for removing the toner remaining on the surface of the image-holding member, wherein the toner-removing unit includes the conductive roll of the above (3).

(13) A thirteenth aspect of the invention is an image-forming apparatus, including an image-holding member, a charging unit for electrostatically charging the image-holding member, an electrostatic latent image-forming unit for forming an electrostatic latent image on the charged image-holding member, a developing unit for forming a toner image by developing the electrostatic latent image formed on the image-holding member with a toner, a transfer unit for transferring the toner image onto an image-receiving member, and a toner-removing unit for removing the toner remaining on the surface of the image-holding member; wherein the toner-removing unit includes the conductive roll of any one of the above (1) to (3).

(14) A fourteenth aspect of the invention is an image-forming apparatus, including an image-holding member, a charging unit for electrostatically charging the image-holding member, an electrostatic latent image-forming unit for forming an electrostatic latent image on the charged image-holding member, a developing unit for forming a toner image by developing the electrostatic latent image formed on the image-holding member with a toner, a transfer unit for transferring the toner image onto an image-receiving member, and a toner-removing unit for removing the toner remaining on the surface of the image-holding member; wherein the toner-removing unit includes the conductive roll of the above (2).

(15) A fifteenth aspect of the invention is an image-forming apparatus, including an image-holding member, a charging unit for electrostatically charging the image-holding member, an electrostatic latent image-forming unit for forming an electrostatic latent image on the charged image-holding member, a developing unit for forming a toner image by developing the electrostatic latent image formed on the image-holding member with a toner, a transfer unit for transferring the toner image onto an image-receiving member, and a toner-removing unit for removing the toner remaining on the surface of the image-holding member, wherein the toner-removing unit includes the conductive roll of the above (3).

What is claimed is:

1. A conductive roll, comprising a core and a coating layer comprising a bismaleimide resin and a conductive agent, the coating layer being formed on the external peripheral surface of the core, wherein the bismaleimide resin is a copolymer of a bismaleimide and an amine compound.

2. The conductive roll of claim 1, wherein the bismaleimide resin is a copolymer of an aromatic bismaleimide and an aromatic amine compound.

3. A cleaning roll, comprising the conductive roll of claim 1.

4. A cleaning roll, comprising the conductive roll of claim 2.

5. A cleaning unit, comprising at least a brush member, a conductive roll disposed in contact with the brush member, and a blade disposed in contact with the conductive roll, wherein the conductive roll is the conductive roll of claim 1.

6. A cleaning unit, comprising at least a brush member, a conductive roll disposed in contact with the brush member, and a blade disposed in contact with the conductive roll, wherein the conductive roll is the conductive roll of claim 2.

7. A process cartridge, comprising at least an image-holding member and a toner-removing element for removing the toner remaining on the surface of the image-holding member, wherein the toner-removing element comprises the conductive roll of claim 1.

8. A process cartridge, comprising at least an image-holding member and a toner-removing element for removing the toner remaining on the surface of the image-holding member, wherein the toner-removing element comprises the conductive roll of claim 2.

9. An image-forming apparatus, comprising:

an image-holding member;

a charging unit for electrostatically charging the image-holding member;

an electrostatic latent image-forming member for forming an electrostatic latent image on the charged image-holding member;

a developing unit for forming a toner image by developing the electrostatic latent image formed on the image-holding member with a toner;

a transfer member for transferring the toner image onto an image-receiving member; and a toner-removing member for removing the toner remaining on the surface of the image-holding member, wherein the toner-removing member comprises the conductive roll of claim 1.

10. An image-forming apparatus, comprising:

an image-holding member;

a charging unit for electrostatically charging the image-holding member;

an electrostatic latent image-forming unit for forming an electrostatic latent image on the charged image-holding member;

a developing unit for forming a toner image by developing the electrostatic latent image formed on the image-holding member with a toner;

a transfer unit for transferring the toner image onto an image-receiving member; and a toner-removing unit for removing the toner remaining on the surface of the image-holding member, wherein the toner-removing unit comprises the conductive roll of claim 2.

11. The conductive roll of claim 1, wherein a molar ratio of the bismaleimide to the amine compound (bismaleimide/amine compound) is in a range of from 1/1 to 4/1 (mole/mole).

* * * * *